US005402589A

United States Patent [19]

Lubrani et al.

[11] Patent Number: 5,402,589

[45] Date of Patent: Apr. 4, 1995

[54] APPARATUS FOR SECURING A SHOELACE COUPLEABLE TO THE TONGUE OF A SHOE AND A SHOE INCORPORATING SUCH AN APPARATUS

[75] Inventors: Mario Lubrani, Eatontown; Bruce D'Andrade, Whitehouse Station, both of N.J.

[73] Assignee: Brookside Enterprises, Inc., Cedar Knolls, N.J.

[21] Appl. No.: 145,389

[22] Filed: Oct. 29, 1993

[51] Int. Cl.[6] ..... A43B 11/00; A43B 23/00

[52] U.S. Cl. ..... 36/50.1; 36/136; 36/54; 24/712.2; 24/712.3

[58] Field of Search ..... 36/1, 50.1, 136, 54; 24/712.1, 712.2, 712.3, 712.4, 712.6

[56] References Cited

U.S. PATENT DOCUMENTS

| | | | |
|---|---|---|---|
| 320,260 | 6/1885 | Knuth | 24/712.2 |
| 575,412 | 1/1897 | Bloom . | |
| 647,824 | 4/1900 | Girtanner . | |
| 819,884 | 5/1906 | Higgins | 24/712.2 |
| 881,041 | 3/1908 | Almstead . | |
| 1,266,823 | 5/1918 | Kohlhaas | 24/712.2 |
| 1,305,884 | 6/1919 | Chromy . | |
| 1,439,241 | 12/1922 | Hoppe | 24/712.6 |
| 3,176,362 | 4/1965 | Tames | 24/712.2 |
| 3,225,402 | 12/1965 | Altman et al. . | |
| 3,290,745 | 12/1966 | Maxwell et al. . | |
| 3,418,733 | 12/1968 | Tyrrell, Sr. et al. . | |
| 4,465,011 | 8/1984 | Merry . | |
| 4,553,293 | 11/1985 | Blum . | |
| 4,715,094 | 12/1987 | Herdman | 24/712.3 |
| 4,805,270 | 2/1989 | Kimbrough | 24/712.3 |
| 5,022,127 | 6/1991 | Ang | 24/712.2 |
| 5,022,127 | 6/1991 | Ang . | |

FOREIGN PATENT DOCUMENTS

| | | |
|---|---|---|
| 194277 | 1/1908 | Germany . |
| 16527 | 4/1904 | United Kingdom . |
| 135431 | 11/1919 | United Kingdom . |

*Primary Examiner*—Paul T. Sewell
*Assistant Examiner*—Marie Denise Patterson
*Attorney, Agent, or Firm*—Stroock & Stroock & Lavan

[57] ABSTRACT

An apparatus for securing a shoelace coupleable to the tongue of a shoe having a first upper portion and a second upper portion includes a spacer mounted on the upper surface of the shoe tongue. A first fixed jaw is mounted on the spacer and the spacer provides a space between the first fixed jaw and the tongue adapted to receive the first upper portion and the second upper portion adjacent thereto. A second movable jaw member cooperates with the first jaw member to form a jaw opening within which an intermediate portion of the shoelace is retained. The apparatus is preferably in the shape of a theme. The shoe is provided with panels which also exhibit a theme in common with the shape of the shoelace securing apparatus. The shoelace securing apparatus is preferable fixed to the shoe tongue.

25 Claims, 2 Drawing Sheets

FIG. 3
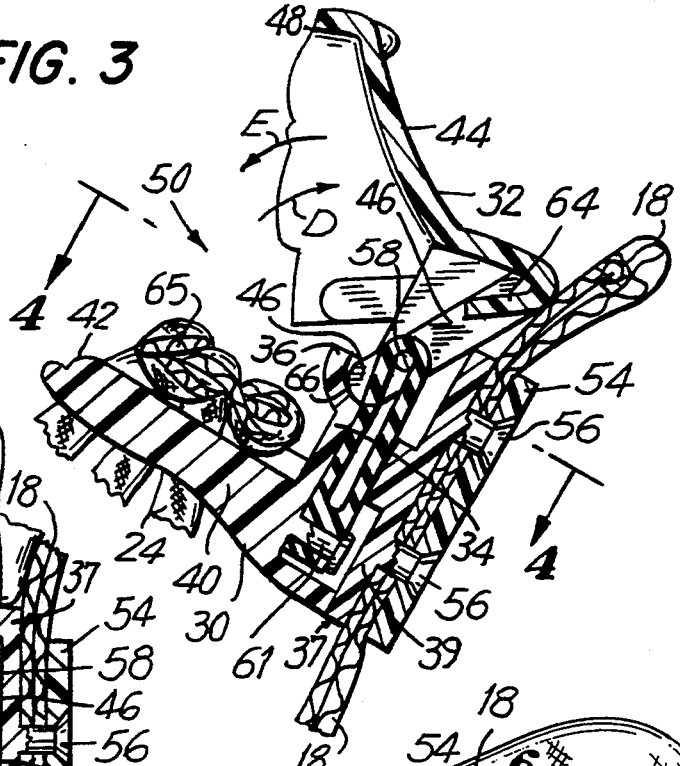
FIG. 4
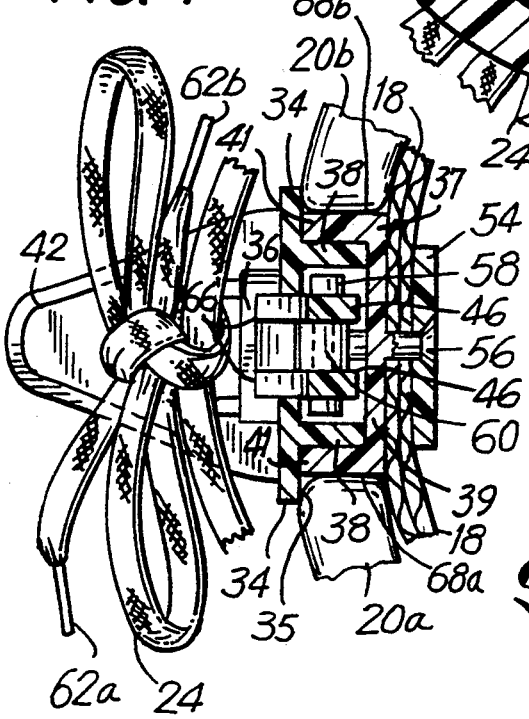
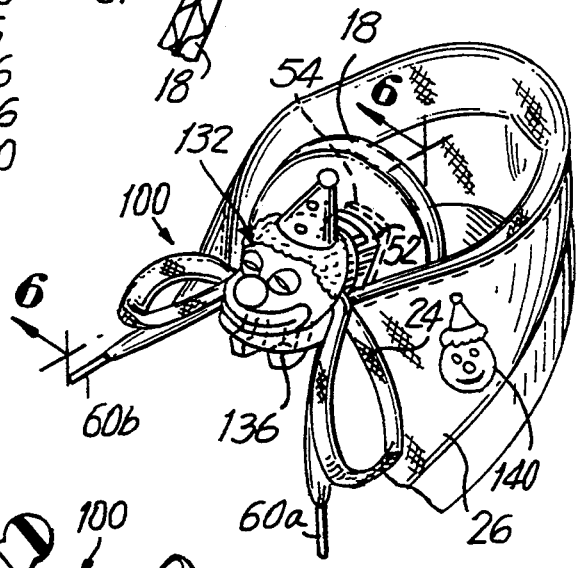
FIG. 5
FIG. 6
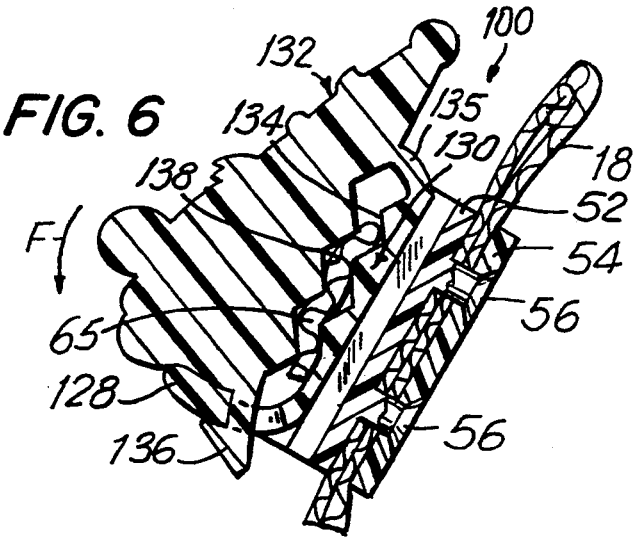

APPARATUS FOR SECURING A SHOELACE COUPLEABLE TO THE TONGUE OF A SHOE AND A SHOE INCORPORATING SUCH AN APPARATUS

BACKGROUND OF THE INVENTION

This invention is related to an apparatus for securing shoelaces coupleable to the tongue of a shoe, and to a shoe incorporating such an apparatus, in general, and in particular to a specific form of such an apparatus capable of securing a shoelace to the tongue of the shoe during intermediate stages in the production of a bow, while at the same time adding increased play value to the shoe.

Shoelace securing devices are known in the art as exemplified by U.S. Pat. No. 4,805,270 and U.S. Pat. No. 5,022,127. U.S. Pat. No. 4,805,270 is directed to a shoelace securing device having first and second jaw members which are mounted flush on a shoe top using the shoelaces with the jaw opening facing away from the shoe. At least one jaw member is displaceable away from the other jaw member at the jaw opening, the jaws being biased to maintain the jaw opening closed. Openings are provided at either sides of the device to receive laces therethrough for anchoring the device to the shoe. During the tying of a knot, the jaws of the device are biased apart by passing the lace between the jaws during the lace tying process. This device holds the lace during intermediate stages in the production of the bow.

The device of U.S. Pat. No. 5,022,127 has a first jaw, or a base, with holes through which laces can be threaded to attach it to the shoe. A second jaw, or cover, is coupled to the first jaw by a hinge and is closed over the first jaw once a knot has been tied, maintaining the knot in a tied position therein.

Both of these shoelace securing devices have proven satisfactory, with the device of U.S. Pat. No. 4,805,270 offering several advantages. However, these prior art shoelace securing devices rest above the shoe and are releasably secured to the shoe only by the laces through holes provided either on the sides of the device or beneath the device through which the shoelaces are passed. The result is a bulkier construction because the device can rest on the shoe upper or in part on the tongue of the shoe and an increased risk that one or both of the devices will be lost, particularly by young children. The bulkiness can cause discomfort to the shoe wearer. Accordingly, it is desirable to provide an apparatus for securing shoelaces which overcomes the shortcomings of the prior art devices described above.

SUMMARY OF THE INVENTION

Generally speaking, in accordance with the invention, a shoelace securing device is formed with first and second jaws adapted to releasably capture at least a finished shoelace knot. At least one jaw member is displaceable from the other jaw member at a jaw opening. Means may be provided to bias the jaw opening in an essentially closed position. The stationary jaw is provided with an integral spacer securable or secured to the tongue of the shoe providing a space between the entrance to the jaws and the shoe tongue. The spacer is dimensioned so that the device rests on the tongue and at least the opposed uppers of the shoe rest at least in part on the tongue on opposed sides of the spacer below the entrance to the jaw. Means is provided for permanently securing the device to the tongue including, by way of example, means extending through the tongue joined to a plate on the lower side of the tongue.

In one embodiment, the second movable jaw member is positioned relative to the first fixed jaw member to define a jaw opening facing essentially away from the shoe. Means are provided to bias the movable second jaw relative to the fixed first jaw member in the essentially closed position of the jaw opening. Camming means are provided at the jaw opening to permit the shoelace to open the jaw opening by displacement of the movable second jaw by the engagement of the lace during knot formation to permit capture and retention by the jaw of an intermediate and a final stage of the knot.

The shoelace securing device may be in part formed in the shape of a character or other recognizable object. Either the second fixed jaw may define the character, or the face of the character or the jaws of the device may correspond to the mouth of a character. The shoe may include decoration display panels, the theme of at least one of the decoration display panels matching the theme of the shoelace securing device.

Accordingly, it is the object of the invention to provide an improved apparatus for securing shoelaces secured to the shoe for displacement therewith even when untied.

Another object of this invention is to provide an apparatus for securing shoelaces which is secured or securable to and rests on the tongue, while permitting the portions of the uppers in which the shoelace holes are contained to also rest in part on the tongue on opposed sides of the device, when the shoe is in a tied condition.

A further object of this invention is to provide a shoe with increased play value by providing decorative display panels matching the theme of the shoelace securing portion of the shoe.

Yet another object of this invention is to provide a shoelace securing device which also acts to anchor the tongue relative to the upper, providing added comfort and insuring that the shoes are worn correctly by children.

Still other objects and advantages of the invention will in part be obvious and will in part be apparent from the specification and drawings.

The invention accordingly comprises features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 3 is an enlarged sectional view of an apparatus for securing shoelaces showing the apparatus in an open position for untying the shoelace in accordance with the invention;

FIG. 4 is a sectional view taken along line 4—4 of FIG. 3;

FIG. 5 is a perspective view of the apparatus for securing shoelaces to the tongue of the shoe constructed in accordance with a second embodiment of the invention; and FIG. 6 is a sectional view taken along line 6—6 of FIG. 5.

DESCRIPTION OF THE PREFERRED EMBODIMENT

Figure 1:
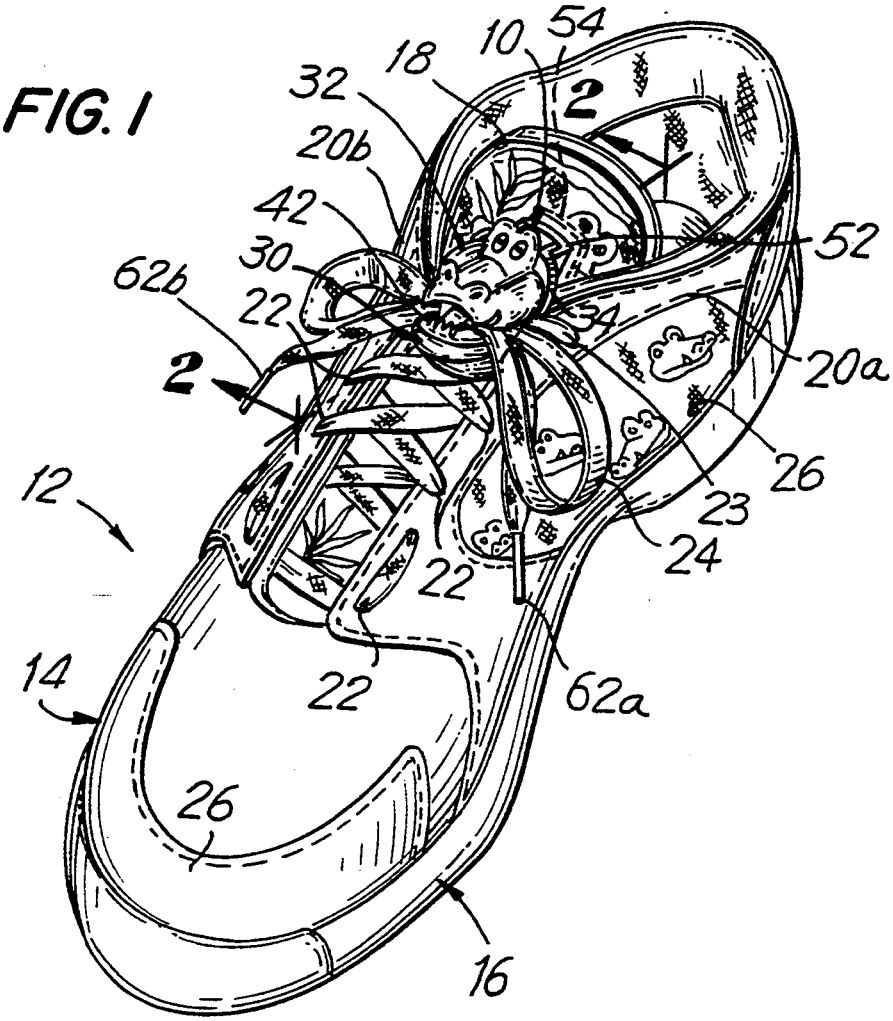
FIG. 1 is a perspective view of an apparatus for securing shoelaces and shoe in accordance with the invention.

Reference is made to FIGS. 1–4, wherein an apparatus for securing a shoelace to the tongue of the shoe, generally indicated as 10 is provided. A shoe 12, is formed with an upper generally indicated as 14 and a sole generally indicated as 16 secured to upper 14. Upper 14 includes a tongue 18, lace receiving upper portions 20*a*, 20*b* having shoelace securing means such as holes 22 formed therein for receiving a shoelace 24 in a laced pattern for holding the shoe 12 on the front of the wearer. Other shoelace securing means such as hooks can be provided on lace receiving upper portions 20*a*, 20*b*. A display panel 26 is formed on shoe upper 14 and a corresponding display panel may be formed on the opposed side of upper 14 adjacent shoelace receiving portion 20*b* (not shown). Other display panels can be provided at other locations on the shoe. One such other display panel is shown on the upper surface of tongue 18. Shoe 12 is also formed with trim 26 provided for decoration and reinforcement, but which can be omitted.

Shoelace securing apparatus 10 is secured to tongue 18 and faces away from shoe 12. Apparatus 10 includes a first fixed jaw member 30, a second movable jaw member 32 and a spacer member 37. First jaw member 30 is integrally formed with a lower wall which may extend essentially parallel to the tongue. Second jaw member 32 is mounted on first jaw member 30 by an over center arrangement more particularly described below.

A laterally extending flange 35 is formed by laterally extending wall 34. First fixed jaw portion 40 of first fixed jaw member 30 extends above wall 34 and is formed integral therewith. First fixed jaw portion 40 extends from essentially one quarter of wall 34 in an upward direction, forming an essentially hollow hemispherical jaw portion. Teeth 42 project from jaw portion 40 towards second jaw member 32. Downwardly projecting walls 38 extend from and are formed integrally with wall 34. Downwardly projecting walls 38 engage and are joined to laterally extending wall 39 and/or upwardly projecting walls 41 of spacer member 37 (FIG. 4). Upward projecting walls 41 serve to cooperate with walls 38 of spacer 37 to position the fixed jaw member relative to the spacer member. Spacer member 37 holds fixed jaw portion 40 spaced from tongue 18.

Second jaw member 32 is formed with an essentially half hemispherical hollow jaw portion projecting upwardly above wall 34. Second jaw member 32 also includes a pair of pivot support members 46 in the central region of the lower periphery of jaw portion 44 which is dimensioned to fit within a space defined between downwardly projecting walls 38, below wall 34. Pivot support members 46 extend in an inclined downwardly direction relative to wall 34 as viewed in FIG. 2 when the second movable member 32 is in the closed position. Pivot support members 46 extend from the lower periphery of jaw portion 34.

The upper ends of jaw portions 40 and 44 are formed with inwardly inclined surfaces 42, 48, respectively which face each other and are inclined toward the interior of jaw portions 40 and 44. The inclined facing surfaces 42, 48 define camming surfaces for the purpose of guiding the laces and knot portions into the open interior of device 10, displacing movable jaw member 32 against a bias force which will more particularly be described below. In the embodiment of FIGS. 1–4, the jaws define the head of an alligator and the inclined surfaces define the teeth and lips. The camming surfaces at the outer periphery of jaw portions 40 and 44 need be provided along only a portion of the periphery thereof sufficient to permit pressure on the laces to cause the movement of second jaw member 32 by the displacement of the laces along the camming surface. Where no teeth are provided, suitable projections or a notch in the periphery of one of the jaw members or inclination may be provided for capturing the laces. Other tooth shapes can be used including an interlocking tooth arrangement as shown in U.S. Pat. No. 4,805,270.

Apparatus 10 is secured to tongue 18 by pins 56 which extend through openings in the tongue and are joined by deformation to plate 54. Pins 56 can be deformed by heat, by way of example, but alternative approaches for securing walls 39 to plate 54 may be used, such as rivets, screws and the like. A pin 58 extends between pivot support members 46 to provide one end of the support for a rubber band 60, the other end of rubber band 60 being secured to first fixed jaw 30 by pin 61. Rubber band 60 provides a biasing force for biasing jaw member 32 towards jaw member 30 maintaining a jaw opening 50 formed between jaw members 32, 30 in a closed position.

In a preferred embodiment, a pair of opposed shoelace holes 23, preferably the uppermost shoelace hole provided within each shoelace securing portion 20*a*, 20*b*, are substantially aligned with each other along a line extending through jaw opening defined by jaw members 30, 32.

Shoe 12 is also provided with one or more display panels 26 which may exhibit designs also coordinated with the ornamental design of shoelace securing device 10, such as the additional alligators as shown in FIG. 1. In an alternative, design panel 26 can depict a swamp scene as seen on the top surface of tongue 18, to have an effect of an alligator living in its swamp. Additionally, simulated alligator skin may be provided in the design of an alligator's hide. By matching a theme between display panels 26 and the apparatus, the imagination of the child is encouraged, increasing the play value and the aesthetic appeal of the shoe is increased and the child is encouraged to wear the shoe.

Figure 2:
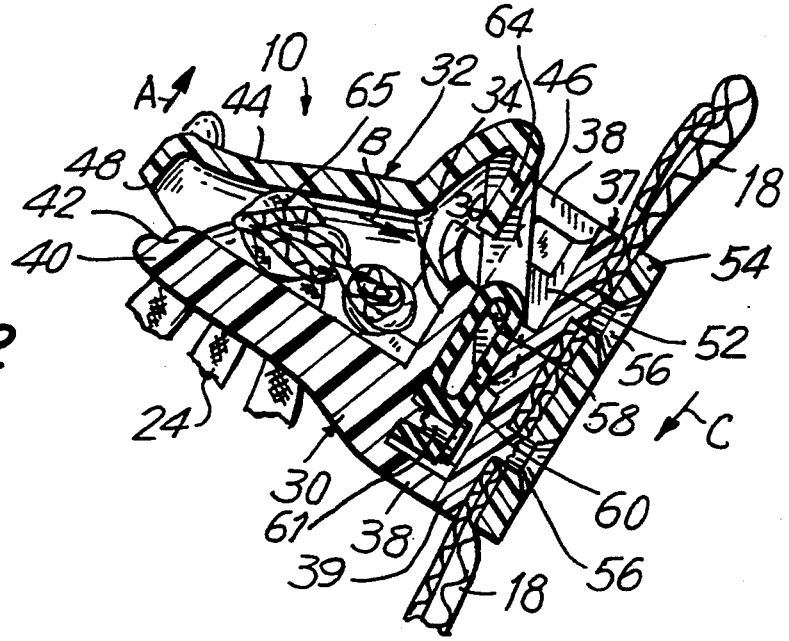
FIG. 2 is an enlarged sectional view taken along line 2—2 of FIG. 1.

During operation, ends 62*a*, 62*b* of a shoelace 24 are crossed across the mouth formed by jaw opening 50 between jaw members 30, 32 and one end 62*a* is passed under the end 62*b* in the first step in forming a knot. The ends are pulled apart in opposite directions to accomplish the first stage of shoe tying. As discussed above, surfaces 42 and jaw member 48 are angled toward each other in the direction of shoe 12 to define camming surfaces. This causes a portion of the knot of shoelace 24 to slide into the interior of the apparatus 10, as shown in U.S. Pat. No. 4,805,270, which is incorporated herein by reference in full. Pulling on the lace ends overcomes the force of rubber band 60, allowing the opening of the jaws by travel of jaw member 32 in the direction of arrow A (FIG. 2). When lace 24, in the first stage of the knot, is stopped by engagement with wall 34, the first stage of the knot is captured and held in position inside shoelace securing device 10, even if the next step of knot tying is not performed. The first stage of the knot is held tight by the biased jaw 32.

Roughly the same procedure is conducted for completing the bow tying portion of tying a shoelace. Each lace end 62*a*, 62*b* is folded and then wrapped around to form a loose knot 65. Each folded end is then pulled apart from each other causing knot 65 to move in the direction of arrow B (FIG. 2) towards wall 34. Again, due to inclined surfaces 42 and 48 the camming surface of jaw 44, second jaw member 32 separates from first jaw member 30 in the direction of arrow A to accommodate knot 65. Furthermore, once the motion of knot 65 has been completed, rubber band 60 provides a force in the direction of arrow C to clamp the jaw members against lace 24 on either side of knot 65 thereby securing knot 65 in place (FIG. 2).

When it is desired to untie the shoelace, shoelace securing apparatus 10 is opened by manually displacing second jaw member 32 to the position shown in FIG. 3 by displacing jaw member 32 in the direction of arrow A until the end of pivot support members 46. As pivot support members 46 clear lip 36, jaw 32 is pivoted in the direction of arrow D so that the end 66 of pivot support members 46 lies within the beveled interior of lip 36 and is maintained in the open position by the force applied by rubber band 60 acting on projection 46 which are positioned within lip 36.

This mounting provides an over center arrangement which prevents inadvertent opening and closing of the apparatus. In the open position (FIG. 3), one end 64 of pivot support members 46 rests on tongue 18 and the other end 66 of pivot support members 46 rests within lip 36. To close the second jaw member, jaw member 32 is pivoted in the direction of arrow E. Once over center, the force of rubber band 60 in the direction of arrow C causes the completion of pivoting by pivot support members 46 and the displacement of second jaw member 32 in the direction of arrow E to the closed position. Accordingly, the actions of rubber band 60 tend to hold second jaw member 32 at either the opened or closed position.

During the tying operation lace securing portions 20*a*, 20*b* are anchored within spaces 68*a*, 68*b* and are maintained in position by flange surfaces 35 and tongue 18. The flange may be defined by a portion of spacer member 37 or first fixed jaw member 30.

Reference is now made to FIGS. 5 and 6 where another embodiment of the invention, generally indicated as 100 is provided. Like numerals are utilized to indicate like structure. The primary difference between the first embodiment and the second is that the first jaw and second jaw are joined together by a hinge without a continual biasing force or over center construction and the top jaw may be entirely formed in a decorative face. The first jaw is manually displaceable.

A spacer 52 is mounted on a tongue 18 utilizing a plate 54 and dowels 56. A first jaw member 130 is mounted on spacer 52 and has an annular wall having a width greater than spacer 52 to form a flange surface (not shown). A projection or catch 128 is integrally formed with first jaw member 130. First jaw member 130 is formed with a serrated surface 134. A second jaw member 132 is formed in the shape of a characters head such as the clown shown by way of example in FIG. 5. Jaw member 132 is coupled to jaw member 130 by a living hinge 135. A hook end or latch 136 extends from second jaw member 132 and passes over and captures catch 136 to maintain jaw members 132 and 130 in a closed position relative to each other. Member 132 is formed with a serrated surface 138.

Again, this embodiment includes a display panel 26 having a clown 140 thereon which is a pictorial depiction of a theme represented by jaw 132 which is also formed in the shape of a clown. It should be noted that display panel 26 is shown at the rear side of an upper 14 when it could be formed at any portion of shoe 12 which has a surface which can be viewed by the user or others while shoe 12 is being worn.

During operation, jaw member 132 is in an open position relative to jaw member 130. Shoelace receiving portions 20*a*, 20*b* are placed in the spaces adjacent spacer 52 formed between first jaw member 130 and tongue 18. A knot is then formed in shoelace 64 on the serrated surface 134 of jaw member 130. Second jaw member 132 is then pivoted about hinge 134 in the direction of arrow F. Hook end 136 is then passed over catch 128 locking jaws 130, 132 in a closed position maintaining knot 65 therebetween (FIG. 6).

To untie the knot, hook end 136 is passed over catch 128 unlocking jaw 132 from first jaw 130. Jaw 132 is then pivoted in a direction opposite to that of arrow F about hinge 134 until access to knot 65 is provided. The knot may then be untied.

By providing a shoe having a shoelace tying apparatus fixedly secured to the tongue, loss of the shoelace securing device is prevented. By affixing the clasp to the tongue, the tongue is now anchored for a better fit of the shoe during use. Additionally, by providing a relatively narrow spacer or member for forming a space between the tongue and the fixed jaw member, the shoe uppers may be anchored in place in the proper wearing position during use. By forming the clasp into a character or an object depicting a theme and by providing that theme in a display area on the shoe surfaces, added play value and improved aesthetics are provided.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for securing a shoelace coupleable to the tongue of a shoe having a tongue and a first and second upper portions, said first and second upper portions each having means for supporting a shoelace; said apparatus for securing a shoelace comprising:

spacer means mounted on the upper surface of the shoe tongue;

a first fixed jaw member mounted on said spacer means and including a first jaw portion for engagement with a shoelace, said shoelace being supported by said first and second upper portions, said spacer means being dimensioned to provide a space between said tongue and first fixed jaw member, said spacer means being dimensioned to receive each of said first and second upper portions on opposed sides thereof for anchoring said upper portions in a predetermined position with said jaw portion above the first and second upper portions; a second movable jaw member having a second jaw portion defining in cooperation with said first jaw portion of said first jaw member a jaw opening therebetween, said second jaw member being mounted for movement relative to said first jaw member at least between an open position and an essentially closed position, said first and second jaw portions being adapted to hold the shoelace in position at said essentially closed position;

retaining means for holding said second movable jaw member at said closed position; and means for securing said apparatus to the shoe tongue.

2. The apparatus for securing a shoelace of claim 1, wherein one of said spacer means and said first fixed jaw member has a laterally extending flange portion positioned to be spaced from the upper surface of the shoe tongue in the region of the first and second upper portions to receive at least a portion of each of the first and second upper portions between the tongue and said flange.

3. The apparatus for securing a shoelace of claim 1, wherein said retaining means includes biasing means for biasing said second movable jaw member toward said first fixed jaw member to close the jaw opening.

4. The apparatus for securing a shoelace of claim 3, wherein said jaw opening faces away from said spacer means; at least a portion of the inner surface of at least one of said first and second jaw portions adjacent the jaw opening being inclined toward said jaw opening and toward said spacer means to define an entrance to said jaw opening and a camming surface for guiding an intermediate portion of the shoelace laterally into the jaw opening and for permitting the force of the shoelace ends being pulled by the user away from the apparatus to displace the displaceable jaw member against the force of said biasing means.

5. The apparatus for securing a shoelace of claim 4, wherein said second movable jaw member is movable both toward and away from said first jaw member and pivotable about an open position, and including over center means for retaining said jaw member at a pivoted open position.

6. The apparatus for securing a shoelace of claim 2, wherein said retaining means includes a cavity within the jaw opening defined by said first and second jaw portions for retaining an intermediate portion of the shoelace therein.

7. The apparatus for securing a shoelace of claim 1, wherein said retaining means including locking means for selectively maintaining the first jaw member in a closed position relative to said second jaw member.

8. The apparatus for securing a shoelace of claim 7, including hinge means joining said second movable jaw member to said first movable jaw member to permit manual displacement of said second jaw member.

9. The apparatus for securing a shoelace of claim 7, wherein said locking means includes a hook end integrally formed with said second jaw member and a retaining latch integrally formed with said first jaw member, said hook end grasping and retaining said retaining latch.

10. The apparatus for securing a shoelace of claim 1, wherein said securing means includes means for passing through said shoe tongue projecting said spacer means; and plate means on the lower side of said shoe tongue fixable to said means for passing through said shoe tongue for holding said shoe tongue between said spacer means and plate means.

11. A shoe comprising a tongue; shoelace securing means affixed to the upper surface of said tongue for receiving a shoelace therein; said shoelace securing means having a shoelace retaining portion and a spacer portion holding said shoelace retaining portion spaced from said tongue, first and second upper portions anchored in position between said spacer portion and shoelace retaining portion by said spacer portion; shoelace retaining means on each of said first and second upper portions positioned on opposed sides of said spacer portion between said shoelace retaining portion and said tongue, whereby a shoelace supported by said shoelace retaining means may be retained in position by said shoelace retaining portion.

12. The shoe of claim 11, wherein said shoelace securing means is at least in part formed in a shape representative of a theme, and display means formed on said shoe for providing information on said shoe, said information having a context, the theme of the shape of said shoelace securing means and the context of the information provided by said display means being recognizable as being related.

13. The shoe of claim 11, wherein said shoelace securing means further comprises a first fixed jaw member mounted on said spacer means and including a first jaw portion for engagement with a shoelace supported by the first and second upper portions; a second movable jaw member having a second jaw portion defining in cooperation with said first jaw portion of said first jaw member a jaw opening therebetween, said second jaw member being movable relative to said first jaw member at least between an open position and an essentially closed position, said first and second jaw portions being adapted to hold the shoelace in position at said essentially closed position;

retaining means for holding said second movable jaw member at said closed position; and means for securing said apparatus to the shoe tongue.

14. The shoe of claim 13, wherein one of said spacer means and said first fixed jaw member has a laterally extending flange portion positioned to be spaced from the upper surface of the shoe tongue in the region of the first and second upper portions to receive at least a portion of each of the first and second upper portions between the tongue and said flange.

15. The shoe of claim 13, wherein said retaining means includes biasing means for biasing said second movable jaw member toward said first fixed jaw member to close the jaw opening.

16. The shoe of claim 13, wherein said jaw opening faces away from said spacer means; at least a portion of the inner surface of at least one of said first and second jaw portions adjacent the jaw opening being inclined toward said jaw opening and toward said spacer means to define an entrance to said jaw opening and a camming surface for guiding an intermediate portion of the shoelace laterally into the jaw opening and for permitting the force of the shoelace ends being pulled by the user away from the apparatus to displace the displaceable jaw member against the force of said biasing means.

17. The shoe of claim 15, wherein said second movable jaw member is movable both toward and away from said first jaw member and pivotable at about an open position, and including over center means for retaining said jaw member at a pivoted open position.

18. The shoe of claim 14, wherein said retaining means includes a cavity within the jaw opening defined by said first and second jaw portions for retaining an the intermediate portion of the shoelace therein.

19. The shoe of claim 13, wherein said retaining means including locking means for selectively maintaining the first jaw member in a closed position relative to said second jaw member.

20. The shoe of claim 19, including hinge means joining said second movable jaw member to said first movable jaw member to permit manual displacement of said second jaw member.

21. The shoe of claim 19, wherein said locking means includes a hook end integrally formed with said second jaw member and a retaining latch integrally formed with said first jaw member, said hook end grasping and retaining said retaining latch.

22. The shoe of claim 13, wherein said securing means includes means for passing through said shoe tongue projecting said spacer means; and plate means on the lower side of said shoe tongue fixable to said means for passing through said shoe tongue for holding said shoe tongue between said spacer means and plate means.

23. The shoe of claim 11, wherein said shoelace securing means is at least in part in the shape of a recognizable object.

24. The shoe of claim 23, wherein said recognizable object is the head of one of a person and animal.

25. The shoe of claim 24, wherein the jaw opening defines the mouth of a object.

* * * * *